US005904319A

United States Patent [19]

Hetzer

[11] Patent Number: 5,904,319

[45] Date of Patent: May 18, 1999

[54] GUIDED MISSILE WITH RAM JET DRIVE

[75] Inventor: Walter Hetzer, Grasbrunn, Germany

[73] Assignee: Daimler-Benz Aerospace AG, München, Germany

[21] Appl. No.: 08/919,982

[22] Filed: Aug. 28, 1997

[30] Foreign Application Priority Data

Sep. 4, 1996 [DE] Germany ..... 196 35 847

[51] Int. Cl.[6] ..... F42B 10/64; F02K 7/10

[52] U.S. Cl. ..... 244/3.24; 60/270.1

[58] Field of Search ..... 244/3.1, 3.24, 244/3.27, 3.28, 3.29, 3.21; 60/270.1; 102/374

[56] References Cited

U.S. PATENT DOCUMENTS

| | | | |
|---|---|---|---|
| 3,154,015 | 10/1964 | Muller | 102/374 |
| 3,373,955 | 3/1968 | Huska | 244/3.21 |
| 3,901,028 | 8/1975 | Leingang | 60/225 |
| 4,327,885 | 5/1982 | Blevins et al. | 244/3.24 |
| 4,327,886 | 5/1982 | Bell et al. | 244/3.29 |
| 4,369,940 | 1/1983 | Kelly et al. | 244/3.21 |
| 4,417,441 | 11/1983 | Crispin et al. | 60/251 |
| 4,560,121 | 12/1985 | Terp | 244/3.22 |
| 4,655,420 | 4/1987 | Spiroff | 244/3.24 |
| 4,660,786 | 4/1987 | Brieseck et al. | 244/3.24 |
| 4,896,502 | 1/1990 | Ravel et al. | 60/270.1 |
| 5,249,761 | 10/1993 | Schroppel | 244/3.21 |
| 5,393,011 | 2/1995 | Dunn et al. | 244/3.21 |
| 5,630,564 | 5/1997 | Speicher et al. | 244/3.24 |

FOREIGN PATENT DOCUMENTS

| | | | |
|---|---|---|---|
| 0 636 852 A 1 | 2/1995 | European Pat. Off. . | |
| 34 41 533 A 1 | 5/1986 | Germany . | |
| 41 35 557 A 1 | 5/1993 | Germany . | |
| 3-199198 | 4/1991 | Japan | 244/3.21 |
| 2218494 | 11/1989 | United Kingdom | 60/270.1 |

*Primary Examiner*—Charles T. Jordan
*Assistant Examiner*—Christopher K. Montgomery
*Attorney, Agent, or Firm*—McGlew and Tuttle

[57] ABSTRACT

A guided missile with ram jet drive, with an engine occupying the airframe cross section, with two outer air intakes in the lower area of the airframe, which lead to the tail with wake shafts, with a tail plane including four separately pivotable vanes in the form of a diagonal cross. A rigid wing arrangement is provided in or in front of the center of the missile. One drive unit with linear movement is provided for each vane. Two of the drive units are arranged longitudinally offset in the longitudinal and circumferential directions of the guided missile in each wake shaft. A kinematic connection from the drive unit to the lower vane is formed by a coupling rod each with joints at both ends. A kinematic connection from the drive unit to the upper vane is formed by a pivotable double lever each and a coupling rod with ball joints at both ends.

20 Claims, 4 Drawing Sheets

GUIDED MISSILE WITH RAM JET DRIVE

FIELD OF THE INVENTION

The present invention pertains to a guided missile with ram jet drive particularly for military applications, with an engine occupying the cross section of the missiles airframe extensively or completely, with two air intakes placed on the airframe contour on the outside in the lower area of the airframe, which are extended with wake shafts to the tail of the missile, with a tail plane comprising four radially arranged, separately pivotable vanes, preferably in the form of a rectangular diagonal cross, wherein the shafts of the lower two vanes lead into the interior of the wake shafts, and with a rigid wing arrangement in the middle to front area of the missile.

BACKGROUND OF THE INVENTION

It frequently happens in missiles with ram jet drives for aerodynamic and design reasons that the airframe cross section is not larger or is only insignificantly larger than the maximum cross section of the engine. Thus, it is usually difficult to integrate additional functional elements within the airframe in the area of the engine. If rocket engines that are independent from the outside air are used as drives, these usually have a greatly contracted nozzle throat, i.e., a greatly reduced diameter in the area between the combustion chamber and the thrust nozzle, because of the high operating pressures. Since this area usually coincides with the tail plane area of the missile, it appears logical to integrate vane boosters, linkages, vane bearings, etc., here in the airframe. The cross section of the combustion chamber is sometimes smaller than the thrust nozzle, so that additional possibilities of installation will arise. However, the trend is increasingly toward air-breathing drives for good reasons, e.g., efficiency and range. Ram jet drives are especially suitable for smaller to medium-sized missiles because of their simple, robust and inexpensive design. However, since these operate with relatively low operating pressures, they require relatively large flow cross sections, and the nozzle throat is contracted only slightly. Thus, this type of engine unfortunately leads to extremely crowded installation conditions for the vane kinematics. The airframe contour is frequently also subject to interface requirements on the part of the firing or carrier devices, the carrier airplane itself, etc., especially in the case of the replacement of existing missiles with improved versions, so that even locally limited expansions of the cross section are frequently impossible.

Missiles have been known in which air intakes placed on the airframe contour on the outside are extended in the form of wake shafts to the tail of the missile primarily for fluidic reasons. If not used for other purposes, these wake shafts may be used for the installation of elements of the vane motor.

SUMMARY AND OBJECTS OF THE INVENTION

Based on a configuration of this type with four radially arranged, separately pivotable vanes and with two wake shafts in the area of the two lower vanes, the primary object of the present invention is to provide a guided missile with ram jet drive, whose vane control system is integrated within the airframe in the best possible manner and fully meets the predetermined requirements, e.g., in terms of the accuracy and speed of control, even under extreme mechanical and thermal conditions.

According to the invention, a guided missile with ram jet drive, especially for military applications, is provided with an engine occupying the cross section of its airframe extensively or completely, with two air intakes placed on the airframe contour on the outside in the lower area of the airframe. These air intakes are extended with wake shafts to the tail of the missile. The tail plane comprises four radially arranged, separately pivotable vanes, preferably in the form of a rectangular diagonal cross. The shafts of the lower two vanes lead into the interior of the wake shafts. A rigid wing arrangement is provided in the middle to front area of the missile. One drive unit, with linear control movement, is provided for each vane. Two of the four drive units are arranged offset in relation to one another in the longitudinal and circumferential directions of the said guided missile in each of two wake shafts with longitudinally oriented direction of movement. Each vane has a linkage articulation point at a spaced location from its pivot axis. The kinematic connection from the drive unit to the linkage articulation point of each of the two lower vanes is formed by a coupling rod with one drag joint or ball joint each at both ends (at the joint end). The kinematic connection from the drive unit to the linkage articulation point of each of the two upper vanes is formed by a double lever pivotable around an axis and a coupling rod with a ball joint each at both ends.

The four drive units with linear control movement for the four vanes are arranged locally concentrated in pairs in the two wake shafts, wherein the double offset—in the longitudinal and circumferential directions of the missile—additionally offers advantages in terms of space engineering. It is thus possible to use sufficiently large/powerful drives, which do not have to be integrated within the airframe itself.

The kinematic connection between the drive and the vane is performed via relatively simple, stable, and space-saving linkages with a small number of bearings and joints, wherein a defined linkage articulation point is provided at each vane.

The linkages for the two lower vanes, comprising a coupling rod with two joints each, are also completely integrated within the wake shafts, like the drive units.

The linkages for the two upper vanes comprise two articulated elements each, namely, a pivotably mounted double lever and a coupling rod with three-dimensionally movable joints. They lead out of the wake shafts and are adapted up to the vanes to the three-dimensional, essentially cylindrical airframe contour.

The drive units are preferably electromechanical motor-gear units, preferably formed as brushless d.c. motors with roll spindle drives. The two drive units for the lower vanes may be arranged in front of the two drive units for the upper vanes, i.e., at a greater distance in front of the plane spanned by the vane pivot axes (R1, R2). The vane linkages for the lower vanes (one coupling rod each) may be adapted in terms of their rigidity, i.e., in terms of their force-deformation characteristics, to the vane linkages for the upper vanes (one double lever each and one coupling rod).

The coupling rods for the lower vanes may be provided with fork head-like joint ends with parallel joint axes.

Each double lever of the linkages for the upper vanes surrounds the nut of a roll spindle drive with a forked end each and accommodates joint pins fastened at the nut in elongated hole-like connecting links with sliding blocks. The nut is secured against rotation.

The pivot axis of each double lever and the joint axis are preferably parallel through the nut of the roll spindle drive, i.e., the axis passing through the center of the joint pin. Each double lever, the intersection of the joint axis through the nut of the roll spindle drive with the spindle axis of the roll spindle axis, the radial and axial center of its said drag bearing, and the center of the coupling rod-side ball joint are preferably located on one line.

At least the majority of the drag and pivot bearings of the vane linkage and of the vanes are preferably designed as rolling bearings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention are illustrated.

DESCRIPTION OF THE PREFERRED EMBODIMENT

Figure 1:
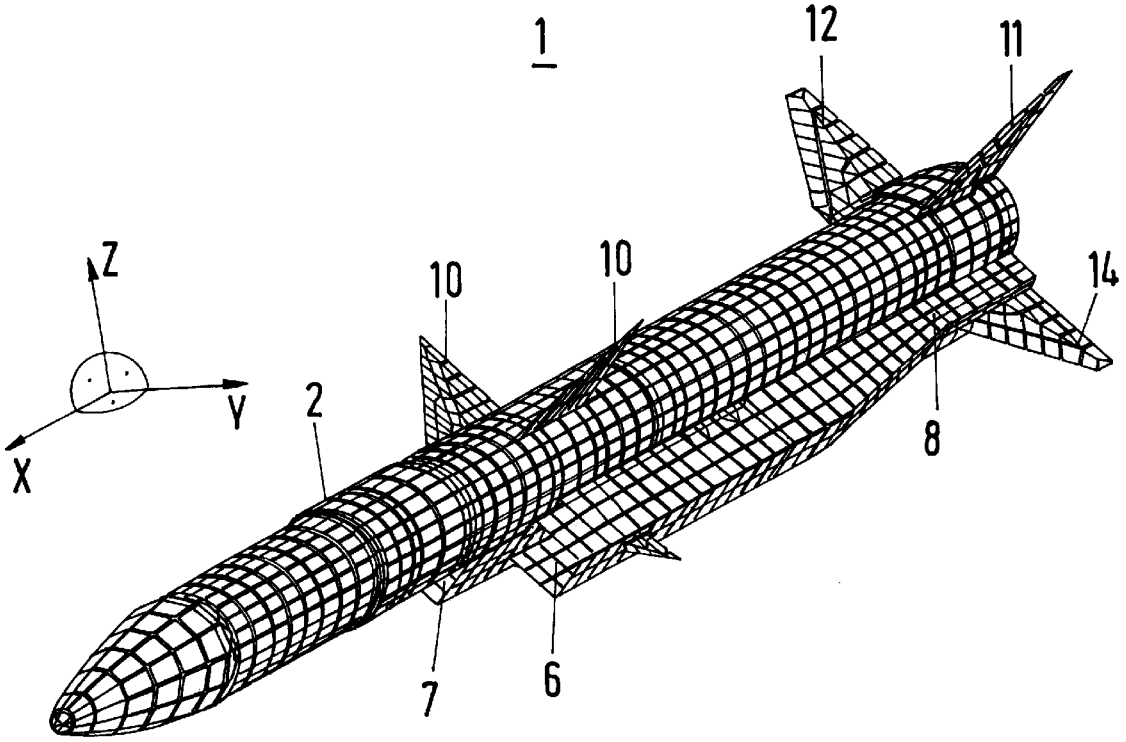
FIG. 1 is a perspective view of a guided missile.

Referring to the drawings in particular, the invention comprises a guided missile with ram jet drive. FIG. 1 shows a perspective view of a guided missile 1 with ram jet drive viewed obliquely from left front and from the top. An orthogonal system of coordinates is shown for illustration, in which the longitudinal axis is designated by X, the transverse axis by Y, and the vertical axis by Z. From the viewpoint of flight mechanics, these would be the roll axis (X), the pitch axis (Y), and the yaw axis (Z). It can be recognized that the airframe 2 of the guided missile 1 has a largely circular cylindrical shape, wherein the diameter somewhat varies locally. Also recognizable are the two air intakes 6, 7, which are placed on the airframe 2 from the outside and are extended in the form of wake shafts 8, 9 (of which only wake shaft 8 is visible in FIG. 1) to the tail of the missile, which offers both aerodynamic and design advantages, especially advantages in terms of space engineering. Four separately movable vanes 11 through 14 (of which 13 is not visible in FIG. 1) in the form of a rectangular diagonal cross are arranged for the aerodynamic control, so that one can speak of two upper vanes 11, 12 and two lower vanes 13, 14. A wing arrangement 10 aligned with the vane cross is present in the middle to front area of the missile, with the lower wings projecting from the air intakes 6, 7 only as short tips. These air intakes 6, 7 are used mainly for the mechanical guiding/fixation, e.g., for mechanical guiding/fixation in a starting device (starting tube or mounting device), rather than for aerodynamic purposes.

Figure 2:
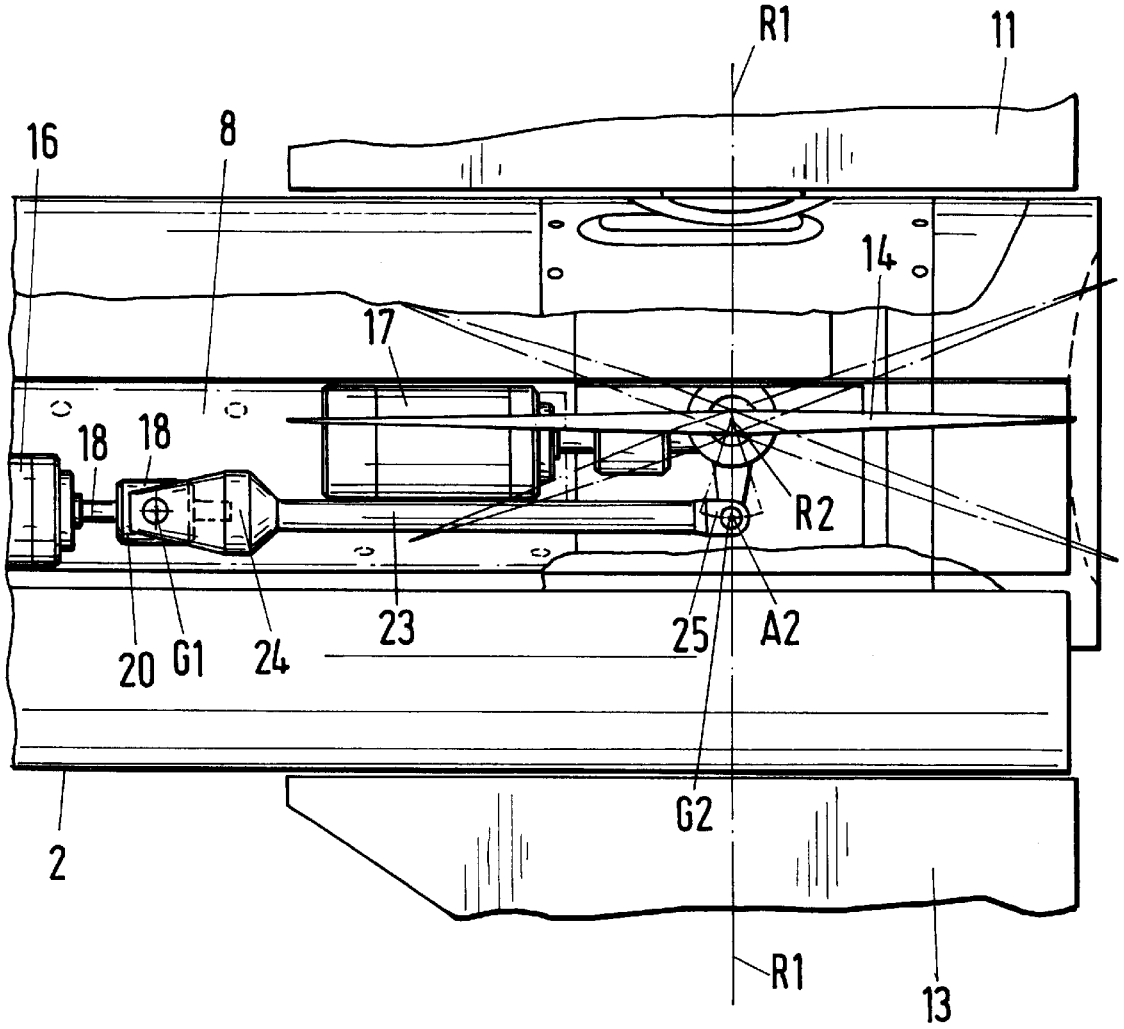
FIG. 2 is a partial side view of a guided missile tail in the axial direction of a lower vane with a view into a wake shaft.

FIG. 2 shows essentially the drive kinematics of the lower left vane 14 viewed from the pivot axis R2 of the vane 14. The lower right vane 13 as well as the upper left vane 11 with their common pivot axis R1 are shown—with broken lines to the outer areas—as a lateral view, as is the horizontally arranged airframe 2. The wake shaft 8 is cut up graphically, so that its interior is visible. The drive unit 16 of the vane 14 in the form of a brushless d.c. electric motor with roll spindle drive 18 is located farthest to the left, i.e., in front in the direction of flight. The drive unit 17 of the vane 11 is offset in relation to the unit 16 in both the longitudinal direction and the circumferential direction of the guided missile 1 and is located closer to the vane axis plane (R1, R2). The vane 14 has—vertically under its pivot axis R2 (as shown in FIG. 2)—a linkage articulation point A2. Between this articulation point A2 and the nut 20 of the roll spindle drive 18 is inserted a coupling rod 23 as a kinematic connection member, which can be subjected to pull and pressure. This coupling rod 23 has fork-like joint ends 24, 25, which surround the nut 20 and the vane lever and are articulated to these. Since the joint axes G1, G2 and the vane pivot axis R2 are parallel according to this preferred embodiment, joints with one degree of freedom, i.e., with pivotability around one axis, are sufficient.

Figure 3:
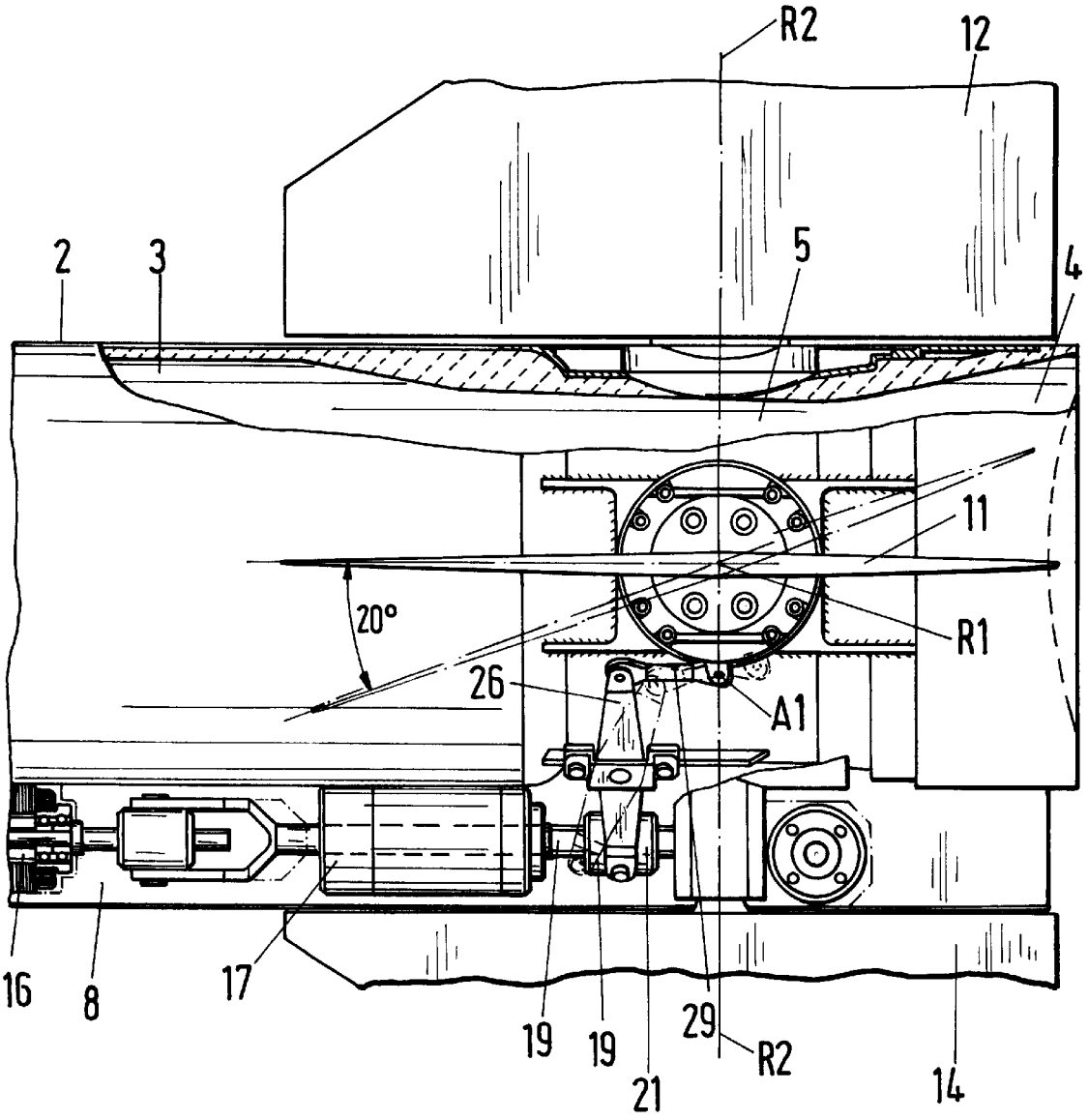
FIG. 3 is a comparable partial view in the axial direction of an upper vane.

FIG. 3 shows essentially the drive kinematics of the upper left vane 11 viewed along its pivot axis R1. The lower left vane 14 as well as the upper right vane 12 with their common pivot axis R2 are shown—broken lines to the radially outer areas—as a side view, as is the horizontally arranged airframe 2. The latter is shown cut up in the upper area of the figure, and the flow channel of the engine can also be seen in the area near the wall. The reference number 3 points approximately toward the area of the downstream ram combustion chamber end, the reference number 5 points toward the area of the nozzle throat, and the reference number 4 points toward the area of the thrust nozzle, more exactly, toward its outlet cross section. It can be recognized that the outer airframe wall has a circular contraction in the area of the nozzle throat 5, in which at least part of the vane mount as well as of the vane linkage are accommodated. The wake shaft 8 is again shown such that its inside is visible, but from a direction differing from that in FIG. 2 by 90°. The partial longitudinal section of the drive unit 16 for the vane 14 is shown in the bottom left area. This is followed, farther right, at the same level, by the view of the drive unit 17 of the vane 11 with its roll spindle drive 19, including the nut 21 thereof. The linkage articulation point of the vane 11 is designated by A1. The control force or control movement is transmitted from the nut 21 to the double lever 26 pivotable around a fixed axis and further, via a coupling rod 29 articulated to the double lever 26, to the point A1. Since the pivot axis R1 of the vane and the pivot axis of the double lever 26 are neither parallel nor do they intersect each other, the coupling rod 29 is provided with two three-dimensionally movable ball joints. The kinematic arrangement corresponds to a so-called Watts linkage, wherein a nearly complete linearity can be achieved between the inlet and outlet movements due to geometric adaptation (lengths, angles, axis positions).

Figure 4:
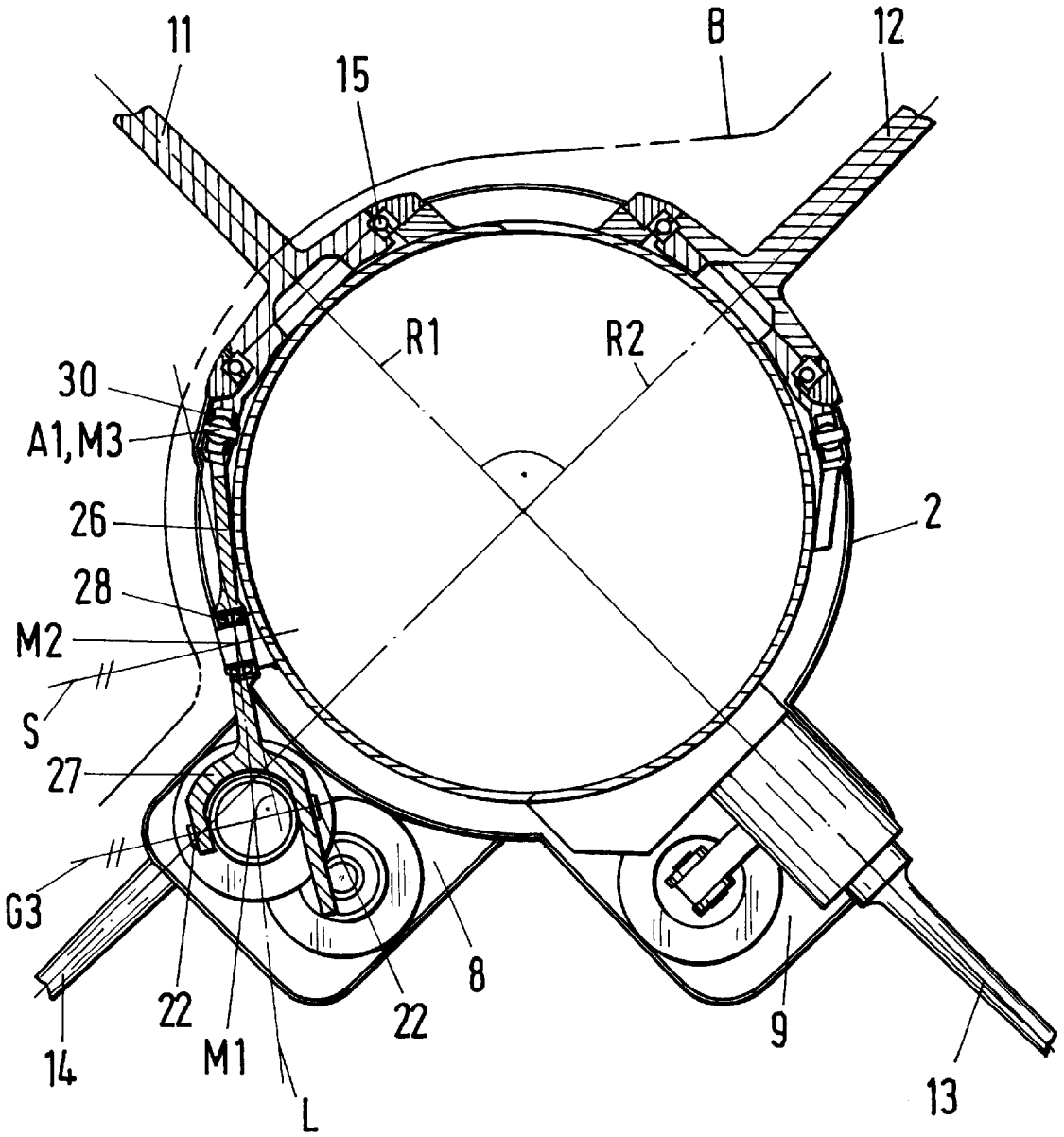
FIG. 4 is a cross section through a missile in the area of the vanes viewed in the rearward direction.

FIG. 4 shows, in addition to FIG. 3, a cross section through the airframe 2 in the pivot axis plane (R1, R2) of the vanes 11 through 14, wherein the section line follows in some areas the linkage of the upper left vane 11. The right-hand wake shaft 9 is thus cut in the plane R1-R2, and the left-hand wake shaft 8, in a plane located farther to the front in the area of the double lever 26 and of the nut 21. Like the vane 12, the vane 11 is guided rotatably around its pivot axis in a clearance-free bearing 15, here in a four-point deep groove ball bearing. Its linkage articulation point A1 coincides with the center M3 of the ball joint 30, which is connected to the coupling rod 29. The double lever-side ball joint has the same center position M3 in this view and is not visible. However, the double lever 26, its drag bearing 28 with the pivot axis S, as well as its lower, forked end 27 are visible in the section. The latter surrounds the nut 21 of the roll spindle drive 19 and is articulated to same. The center of the nut 21 is designated by M1 here. Joint pins 22, which shall be mounted rotatably in sliding blocks, are fastened to the nut 21, and the sliding blocks shall be guided in the two legs of the forked end 27 of the double lever 26 in a limitedly displaceable manner. The nut 21 shall be secured against rotation separately. This sliding block guiding is necessary to avoid damaging constraining forces in the given kinematics, with the transition from linear movement to pivoting movement. However, it is not meaningful to represent these details at the given scale of the drawing for lack of recognizability. The person skilled in the art is familiar with the design anyway.

The joint axis defined by the joint pins 22 is designated by G3. This and the pivot axis S of the double lever 26 are parallel in order to avoid constraining forces and deformations in the area of the fork. The centers M1 through M3 are located on a line L, which extends within or approximately at the edge of the cross section of the material of the double lever 26. The flux of force thus obtained leads only to minimal local torsional loads in the double lever 26, which increases the rigidity of the transmission kinematics.

Due to the drive units 16 for the lower vanes 13, 14 being located at a markedly greater distance in front of the pivot axis plane R1-R2 than the drive units 17 of the upper vanes 11, 12, the rigidity behavior of the relatively long and therefore "softer" coupling rods 23 can be adapted to the "total rigidity" of the specifically "harder" shorter elements 26 through 29, which is advantageous for the control precision of the vane arrangement.

The boundary line B extending from the vane 12 into the area of the vane 14 represents the contours predetermined by the starting device, from which contour the outer contour of the missile must maintain a certain distance, with the exception of the vane 11, and this also affects the vane linkage to the vane 11.

While specific embodiments of the invention have been shown and described in detail to illustrate the application of the principles of the invention, it will be understood that the invention may be embodied otherwise without departing from such principles.

What is claimed is:

1. A guided missile with ram jet drives, comprising:

an airframe with an airframe contour;

an engine extensively occupying a cross section of said airframe, the engine having two air intakes defining an air intake airframe contour on the outside of the airframe in a lower area of the airframe, the air intake airframe contour having wake shafts extending from said air intakes to the tail of the missile;

a tail plane comprising four radially arranged, separately pivotable vanes with two vanes each lying on upper and lower areas of the airframe to provide two upper vanes and two lower vanes, with shafts of the lower two vanes leading into the interior of the wake shafts;

a rigid wing arrangement in a forward to middle section along the longitudinal axis of the missile;

drive units, each of said drive units having a linear control movement for one of said pivotable vanes, two of said four drive units being arranged offset in relation to one another in a longitudinal and a circumferential direction of the missile in each of said two wake shafts, said two of said four drive units having a direction of movement which is substantially in said longitudinal direction of the missile, each of said vanes having a linkage articulation point at a spaced location from a pivot axis thereof;

a lower vane kinematic connection from a drive unit, of said drive units, in each of said wake shafts to a corresponding linkage articulation point of a corresponding lower vane formed by a coupling rod with one of a drag joint and ball joint at ends of said coupling rod; and an upper vane kinematic connection from a drive unit of said drive units, in each of said wake shafts, to a corresponding linkage articulation point of a corresponding upper vane formed by a double lever pivotable around an axis and a coupling rod with a ball joint at ends of said coupling rod.

2. The guided missile in accordance with claim 1, wherein said drive units are electromechanical motor-gear units.

3. The guided missile in accordance with claim 2, wherein said drive units are brushless d.c. motors with roll spindle drives.

4. The guided missile in accordance with claim 1, wherein two of said drive units are for said lower two vanes and two of said drive units are for said upper two vanes and said said drive units for said lower vanes are arranged in front of two of said drive units for said upper vanes, providing a greater distance between said drive units for said lower vanes and a plane spanned by said vane pivot axes than between said drive units for said upper vanes and said plane spanned by said vane pivot axes, and each said lower vane kinematic connection is adapted in terms of rigidity, including force-deformation characteristics, to vane linkages for said upper vane kinematic connection.

5. The guided missile in accordance with claim 1, wherein said coupling rod of each said lower vane kinematic connection is provided with fork joint ends with parallel joint axes.

6. The guided missile in accordance with claim 1, wherein said double lever of said upper vane kinematic connection has a forked end which with a first portion and a second portion that cooperate to surround a nut of a roll spindle drive and accommodates joint pins fastened at said nut in elongated connecting links with sliding blocks, wherein said nut is secured against rotation.

7. The guided missile in accordance with claim 6, wherein said pivot axis of said double lever and a joint axis through said nut of said roll spindle drive, passing through the center of said joint pin are parallel.

8. The guided missile in accordance with claim 7, wherein each said double lever has an intersection of said joint axis through said nut of the said roll spindle drive with said spindle axis of said roll spindle drive, a radial and axial center of a drag bearing, and a center of a coupling rod-side ball joint are located on one line.

9. The guided missile in accordance with claim 4, wherein at least a majority of drag and pivot bearings of said upper vane kinematic connection and said lower vane kinematic connection of said vane linkage and of said vanes are designed as rolling bearings.

10. The guided missile in accordance with claim 1, wherein said separately pivotable vanes are in the form of a rectangular diagonal cross.

11. A missile, comprising:

an airframe with an airframe contour including two air intake contours extending into wake shafts;

an engine including a ram jet drive, said engine almost completely occupying a cross section of said airframe apart from said wake shafts, said engine having two air intakes at said air intake contours in a lower area of the airframe;

a tail plane comprising four radially arranged, separately pivotable vanes with two vanes each lying on upper and lower areas of the airframe to provide two upper vanes and two lower vanes, shafts of the lower two vanes leading into the interior of the wake shafts;

drive units, each of said drive units having a linear control movement for driving one of said pivotable vanes, two of said four drive units being arranged offset in relation to one another in a longitudinal and a circumferential direction of the missile in each of said two wake shafts, said two of said four drive units having a direction of movement which is substantially in said longitudinal direction of the missile, each of said vanes having a linkage articulation point at a spaced location from a pivot axis thereof;

a lower vane kinematic connection from a drive unit, of said drive units, in each of said wake shafts to a corresponding linkage articulation point of a corresponding lower vane formed by a coupling rod with one of a drag joint and ball joint at ends of said coupling rod; and an upper vane kinematic connection from a drive unit of said drive units, in each of said wake shafts, to a corresponding linkage articulation point of a corresponding upper vane formed by a double lever pivotable around an axis and a coupling rod with a ball joint at ends of said coupling rod.

12. The missile in accordance with claim 11, wherein said drive units are electromechanical motor-gear units.

13. The missile in accordance with claim 12, wherein said drive units are brushless d.c. motors with roll spindle drives.

14. The missile in accordance with claim 11, wherein two of said drive units are for said lower two vanes and two of said drive units are for said upper two vanes and said said drive units for said lower vanes are arranged in front of two of said drive units for said upper vanes, providing a greater distance between said drive units for said lower vanes and a plane spanned by said vane pivot axes than between said drive units for said upper vanes and said plane spanned by said vane pivot axes, and each said lower vane kinematic connection is adapted in terms of rigidity, including force-deformation characteristics, to vane linkages for said upper vane kinematic connection.

15. The missile in accordance with claim 11, wherein said coupling rod of each said lower vane kinematic connection is provided with fork joint ends with parallel joint axes.

16. The missile in accordance with claim 11, wherein said double lever of said upper vane kinematic connection has a forked end which with a first portion and a second portion that cooperate to surround a nut of a roll spindle drive and accommodates joint pins fastened at said nut in elongated connecting links with sliding blocks, wherein said nut is secured against rotation.

17. The missile in accordance with claim 15, wherein said pivot axis of said double lever and a joint axis through said nut of said roll spindle drive, passing through the center of said joint pin, are parallel.

18. The missile in accordance with claim 17, wherein each said double lever has an intersection of said joint axis through said nut of the said roll spindle drive with said spindle axis of said roll spindle drive, a radial and axial center of a drag bearing, and a center of a coupling rod-side ball joint are located on one line.

19. The missile in accordance with claim 14, wherein at least a majority of drag and pivot bearings of said upper vane kinematic connection and said lower vane kinematic connection of said vane linkage and of said vanes are designed as rolling bearings.

20. The missile in accordance with claim 11, wherein said separately pivotable vanes are in the form of a rectangular diagonal cross.

* * * * *